US005980662A

United States Patent [19]

Kim et al.

[11] Patent Number: 5,980,662

[45] Date of Patent: Nov. 9, 1999

[54] METHOD FOR BATCH ANNEALING OF AUSTENITIC STAINLESS STEELS

[75] Inventors: Yeong-U Kim, Export; Lewis L. Kish, Sarver; Nazmi Toker, Monroeville, all of Pa.

[73] Assignee: Allegheny Ludlum Corporation, Pittsburgh, Pa.

[21] Appl. No.: 08/837,696

[22] Filed: Apr. 22, 1997

[51] Int. Cl.[6] ..... C21D 9/00

[52] U.S. Cl. ..... 148/579; 148/601; 148/611

[58] Field of Search ..... 148/597, 601, 148/611

[56] References Cited

FOREIGN PATENT DOCUMENTS

| | | | |
|---|---|---|---|
| 59-35635 | 2/1984 | Japan | 148/601 |
| 405295453 | 11/1993 | Japan | 148/601 |

OTHER PUBLICATIONS

"Handbook of Stainless Steels," D. Peckner and I. M. Bernstein, pp. 4–34– through 4–45, 1977.

EBNER product brochure, "HICON/H2 Bell Annealers for Steel Strip," Effective 1993.

EBNER Furnaces, Inc. brochure, "Introducing our Company," Effective 1993.

EBNER Furnaces, Inc. technical report, "EBNER HICON/H2 Bell Annealer," W. F. Gasse, 1995.

*Primary Examiner*—Deborah Yee

*Attorney, Agent, or Firm*—Robert J. Pugh; Patrick J. Viccaro

[57] ABSTRACT

Methods are provided for annealing coils of austenitic stainless steels through the use of a batch annealing process. The preferred methods involved selecting compositions of austenitic stainless steel alloys having a sufficiently low weight percentage of carbon so that annealing of the austenitic stainless steel occurs without intergranular carbide precipitation at a temperature of less than about 1700° F., which is well below the normal annealing temperature for austenitic stainless steels. The lower annealing temperatures allow for annealing in conventional batch annealing furnaces. The content of carbon in T-201L stainless steel was kept at less than 0.030 weight percent and the steel was successfully annealed at temperatures within a range of about 1650° F. to about 1700° F. The carbon content of T-304L stainless steel was kept at less than 0.015 weight percent and the steel was successfully annealed at temperatures within a range of about 1550° F. to about 1700° F. For light gauge strip, the winding tension of the coiled stainless steel was reduced prior to the batch annealing process. In particular, winding tensions of less than about 30,000 psi were beneficial, with good results being found when the winding tension was held within the range of about 15,000 psi to about 3,000 psi.

21 Claims, 2 Drawing Sheets

METHOD FOR BATCH ANNEALING OF AUSTENITIC STAINLESS STEELS

BACKGROUND OF THE INVENTION

1. Field of the Invention

The present invention relates generally to a method for batch annealing austenitic stainless steels. More particularly, the present invention relates to the selection of alloy compositions, to the preparation of the stainless steel coils, and to the defining of appropriate annealing parameters in order to successfully perform batch annealing of austenitic stainless steels, including light to foil gauge stainless steels.

2. Description of the Prior Art

In the manufacture of flat-rolled stainless steel sheet and strip products, it is necessary to intermittently anneal or soften the material for further cold-rolling operations. It is also necessary to anneal the material at the finish gauge to render it suitable for fabrication (i.e., stamping, forming, etc.). Annealing is necessary because cold reduction elongates the grains of the stainless steel, greatly distorts the crystal lattice, and induces heavy internal stresses. The steel that results from the cold reduction process is typically very hard and has little ductility. The annealing process allows the cold-worked steel to recrystallize, and if the steel is held at the proper annealing temperature for a sufficient time, the structure of the annealed steel will again consist of undistorted lattices and the steel will again be soft and ductile.

Annealing techniques may be divided into two general categories: (a) batch operations, such as conventional box annealing; and (b) continuous operations. In the stainless steel industry, the softening of flat rolled sheet and strip products is most commonly accomplished through the use of continuous annealing lines.

The continuous annealing process involves unwinding the coil from a payoff reel and continuously feeding the coil into and pulling the coil through a furnace and then rewinding the coil on a take-up reel. The furnace is typically electric or gas fired. The steel strip, while traveling in the furnace, is typically heated to a temperature in the range of about 1800° F. to about 2200° F. in the case of austenitic alloys and to a temperature in the range of about 1400° to about 1800° F. for ferritic alloys. The annealing temperatures vary depending upon the particular alloy being annealed, as well as the alloy's intended end-use.

The demand for light to foil gauge (i.e, 20 mils or less) stainless steel strip products (hereinafter referred to as "light gauge stainless steels" or "light-gauge strip") has increased in the stainless steel industry in recent years. In fact, stainless steel strip/foil products having such light gauges are in demand and are included in the product lines of a number of steel producers.

Annealing light gauge stainless steels presents technical as well as economical problems to the stainless steel industry. For example, during the high temperature continuous annealing of light-gauge stainless steels in the temperature range of about 1800° F. to about 2200° F. for austenitic stainless steel alloys, the yield strength of the material is greatly reduced thus making the strip prone to breaking. The breakage of the light gauge strip can be frequent in the continuous annealing line furnaces and the subsequent downtime and material loss can be costly. Furthermore, the productivity with light gauge stainless steel strip is very low compared to that for conventional gauge products, since the productivity for the light-gauge strip becomes limited by the maximum line speed allowed by the continuous annealing lines. Adding additional continuous annealing lines to increase productivity would be costly. Thus, the operating costs associated with such light gauge stainless steel can be relatively high.

One potential alternative to continuous annealing of light-gauge stainless steel strip is batch annealing. However, batch annealing has not been utilized for stainless steel austenitic alloys. For stainless steels, batch annealing has been utilized mostly in connection with heat treatment, at about 1400° F. to about 1600° F., of ferritic grades at hot-rolled band and, to a lesser extent, at intermediate gauge to soften the material for further cold reduction.

Significant improvements have been made in batch annealing technology since the late 1970s. Such improvements have come through the introduction of 100% hydrogen atmosphere, high convection devices, improved furnace design, and modern computer controls. These improvements in the batch annealing technology have resulted in an increase of energy efficiency and improvement of heat transfer rates during both heating and cooling periods, thereby producing more uniform properties throughout the coil and reducing the process cycle time by more than 50% over older batch annealing operations. The above-mentioned improvements, together with alternative impeller materials, have resulted in maximum temperatures attainable in commercially available annealing furnaces of approximately 1650° F. or more. However, with further modifications and advancements, temperatures of 1700° or higher should be achievable.

As noted above, batch annealing has not been utilized in connection with austenitic stainless steel alloys in general for a number of reasons. For example, austenitic stainless steel alloys require higher annealing temperatures than existing batch annealing furnace equipment would be able to sustain. Also, at the cooling rates allowed by conventional batch annealing, carbides would precipitate on grain boundaries and cause a breakdown of corrosion properties, which are among the most critical properties in stainless steels. Moreover, at the temperatures required for annealing the austenitic alloys, it is likely that sticking or localized diffusion welding would develop between adjacent coil laps and damage the surface of the strip. At light gauges, the sticking can be so severe that the strip can actually tear or at least develop creases during rewinding.

In summary, some minimum annealing temperature is required for recrystalization of typical 200 series and 300 series stainless steel alloys. However, it is known in the industry that as the austenitic stainless steel alloys are heated, intergranular carbide precipitation begins at temperatures of about 900° F. or more. At even higher temperatures, the carbides begin to dissolve, with relatively high temperatures required for typical alloys to achieve substantially complete carbide dissolution. For example, typical T-304 stainless steel has approximately 0.075% carbon by weight and requires during conventional line annealing an annealing temperature of approximately 1850° F. to achieve substantially complete carbide dissolution. The required annealing temperature for typical T-201 stainless steel is generally similar. If the temperature required for substantially complete carbide dissolution is not reached, intergranular carbides can remain and make the alloys unusable. As a result, the industry has utilized annealing techniques for austenitic stainless steel alloys that achieve relatively high annealing temperatures in order to dissolve carbides and also that achieve sufficiently high cooling rates in order to prevent carbides from forming during cooling. Carbides that are not dissolved during annealing or that form during cooling can render the alloy unusable.

Even with advances in batch annealing technology, batch annealing furnaces typically reach less than 1700° F., which is below the temperature necessary for the substantially complete dissolution of carbides to occur in typical austenitic stainless steel alloys.

Even if the temperature at 1800° F. is reachable by further advances of batch annealing technology, the cooling rate of the stainless steel coils after annealing at 1800° F. would not be fast enough in a batch annealing furnace to prevent intergranular carbide precipitation in typical austenitic stainless steel alloys. According to a Continuous Cooling Transformation diagram, published in "Handbook of Stainless Steels"—McGraw-Hill, Inc., 1977, for typical T-304 alloys with 0.075 percent carbon by weight, the maximum time allowed for the coil to cool from 1800° F. to approximately 1250° F. is about 200 seconds to prevent intergranular carbide precipitation. Typically, it would take approximately 15 to 20 hours for coils to cool from about 1800° F. to approximately 1250° F. in production-scale batch annealing furnaces, which is not fast enough to prevent intergranular carbide precipitation in typical austenitic stainless steels. Thus, the annealing technique generally utilized for austenitic stainless alloys is continuous annealing in which high annealing temperatures of about 1800° F. to about 2200° F. are typically reached, and the cooling, often assisted by air blasting, is fast enough to avoid intergranular carbide precipitation.

However, as noted above, the productivity of continuous annealing lines is limited by the maximum speed of the line. Further, the continuous annealing line incur additional drawbacks such as strip breakage due to the greatly reduced yield strength at these high temperatures. This is particularly acute when the material is in the form of light gauge austenitic stainless steel. Correction of these problems is costly and would further reduce productivity.

Therefore, there is a need in the stainless steel industry to develop methods of batch annealing austenitic stainless steel strip, particularly light-gauge strip, that will result in final material properties that are equivalent or superior to those produced on conventional continuous annealing lines. Such methods should avoid the drawbacks associated with the processing of light-gauge stainless steels on such conventional continuous annealing lines. Such methods should also, where possible, utilize existing furnace equipment. In addition, such methods should avoid the development of sticking or localized diffusion welding between adjacent laps of the coils.

There are several austenitic stainless steels well known in the industry that have relatively low amounts of carbon. Examples of such low carbon austenitic stainless steels include T-201L and T-304L. T-201L has the following chemical composition by weight percent: 0.03 max C, 16.0–18.0 Cr, 5.5–7.5 Mn, 0.25 max N, 3.5–5.5 Ni, 0.045 max P, 0.030 max S, and 0.75 max Si. T-304L has the following chemical composition by weight percent: 0.03 max C, 18.0–20.0 Cr, 2.0 max Mn, 8.0–11.0 Ni, 0.045 max P, 0.030 max S, and 1.0 max Si.

Accordingly, it is an object of the present invention to develop methods of batch annealing austenitic stainless steel coils that will render final material properties equivalent to or superior to those produced on conventional continuous annealing lines. It is a further object of the present invention to allow the methods of batch annealing austenitic stainless steel materials to be utilized in connection with light-gauge products in which surface damage, such as caused by sticking between adjacent laps of coil, is minimized. It is yet a further object of the present invention to lower production costs over conventional continuous annealing lines while avoiding the drawbacks associated with such conventional continuous annealing lines.

SUMMARY OF THE INVENTION

Methods are provided for annealing coils of austenitic stainless steels through the use of a batch annealing process. The preferred methods achieve desired mechanical properties, surface appearance, corrosion properties, and strip shape of the stainless steel coils with minimal sticking between laps. The preferred methods involved selecting compositions of austenitic stainless steel alloys having particular levels of carbon therein. For example, favorable results have been obtained in the heat treatment of ASTM 200 and 300 series stainless steels when the carbon content of these alloys is at a very low level. The present methods also utilize a particular annealing atmosphere and particular annealing cycle parameters.

The methods disclosed herein are particularly well-suited for use with light gauge stainless steel products. The methods involve selecting a composition of austenitic stainless steel alloys having a sufficiently low weight percentage of carbon so that annealing of the austenitic stainless steel occurs without intergranular carbide precipitation at a temperature of less than about 1700° F., which is well below the normal annealing temperature for austenitic stainless steels. The lower annealing temperatures allow for annealing in conventional batch annealing furnaces. In this way, the drawbacks associated with continuous annealing processes (i.e., down time due to strip breakage and limits on maximum line speed), can be greatly reduced.

Particular success was found in the batch annealing of T-201L stainless steel. The content of carbon in the T-201L stainless steel was kept at less than 0.030 weight percent. At these levels of carbon, the austenitic T-201L stainless steel was successfully annealed at temperatures within a range of about 1650° F. to about 1700° F. for an anealing time of about 0 to about 12 hours. Based on the results of the experimentation, it appears that successful annealing should occur at temperatures as low as 1600° F.

Successful results were also found with a T-304L stainless steel. The carbon content of the T-304L stainless steel was kept at less than 0.015 weight percent. At this level of carbon content, the T-304L austenitic stainless steel annealed successfully at temperatures within a range of about 1550° F. to about 1700° F.

Sticking or localized diffusion welding between adjacent laps of annealed coil, which damages the surface of the strip, is further alleviated by reducing the tension under which the stainless steel is wound into coils (i.e., the winding tension) in preparation for the batch annealing process. In particular, winding tensions of less than about 30,000 psi were beneficial with particular good results being found when the winding tension was held within the range of about 15,000 psi to about 3,000 psi. Typical prior art coils are wound with tensions of about 30,000 psi or greater.

Other objects and advantages of the invention will become apparent from a description of certain present preferred embodiments thereof shown in the drawings.

DETAILED DESCRIPTION OF THE PREFERRED EMBODIMENTS

Figure 1:
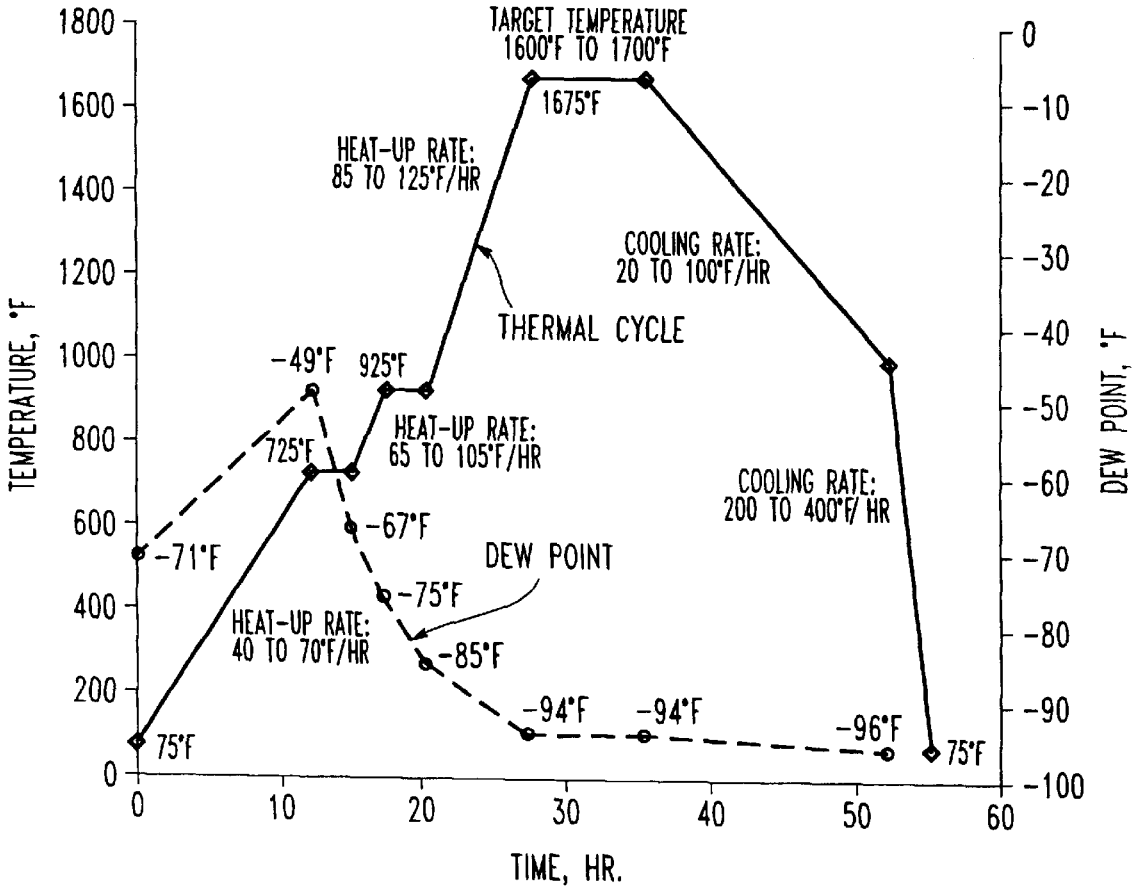
FIG. 1 is a graphical depiction of a typical annealing cycle for the T-201L alloy according to the present invention.
Figure 2:
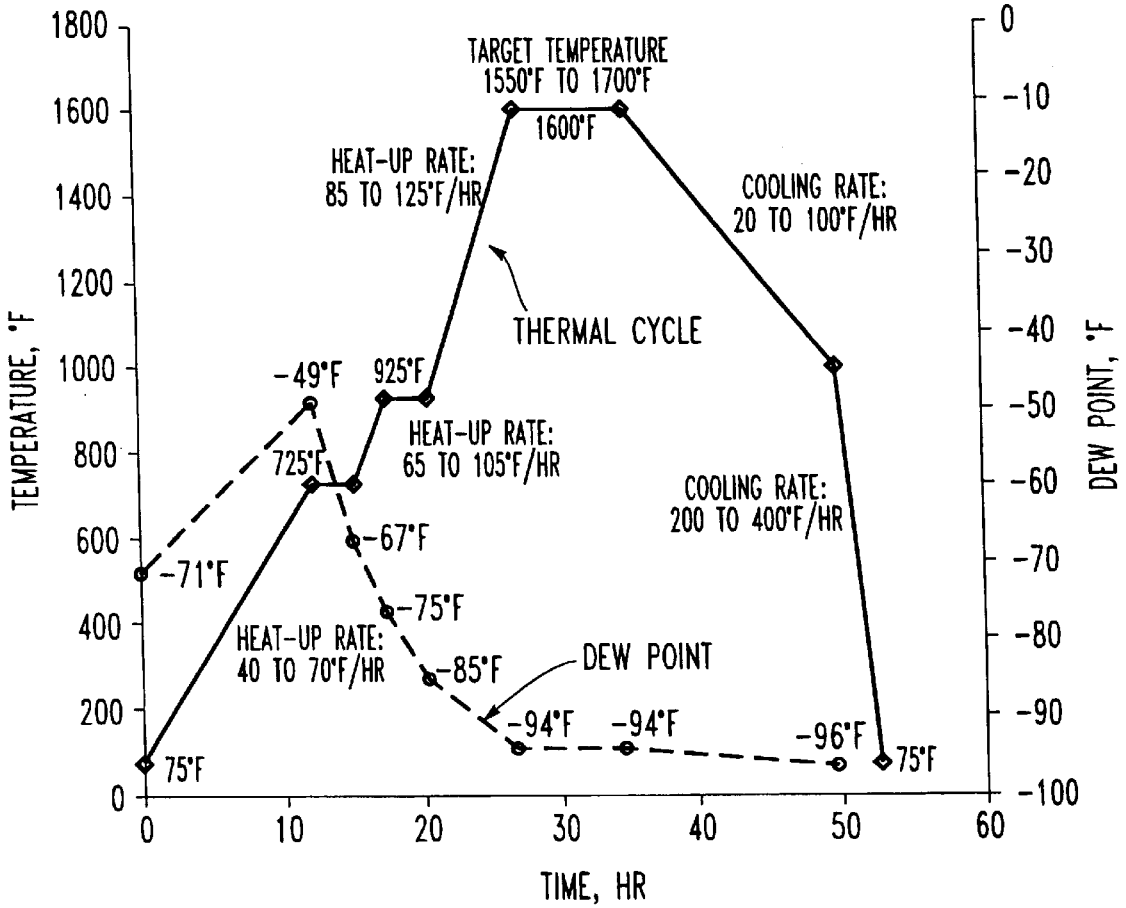
FIG. 2 is a graphical depiction of a typical annealing cycle for the T-304L alloy according to the present invention.

The methods of the present invention provide a means for annealing coils of austenitic stainless steel through the use of a batch annealing process. The methods involve utilizing stainless steel alloys having extra low levels of carbon. The methods also involve the use of appropriate coiling tension, hydrogen annealing atmosphere and particular annealing cycle parameters.

An important feature of the invention is to limit the weight percentage of carbon in the austenitic stainless steel alloys. When the carbon content in the alloy is kept to an extra low level, the required annealing temperatures can be kept low enough that existing batch annealing technology can be utilized to anneal the alloys. Further, the low carbon content allows for microstructures to be developed with no intergranular carbides and, thus, no intergranular corrosion susceptibility. According to the present invention, for the T-201L alloy, the carbon content should be less than 0.030% by weight in order to produce acceptable mechanical and corrosion properties by the batch annealing process. For the T-304L alloy, the carbon content should be less than 0.023% and preferably less than about 015% by weight in order to produce acceptable mechanical and corrosion properties by the batch annealing process. The lower limit of the carbon content is set by practical limitations of melting technology.

A major problem encountered through batch annealing of coils, particularly light-gauge coils, is sticking or localized diffusion welding developed between adjacent laps. Such sticking can tear or develop creases in the coil during rewinding. It was found that the sticking of the coils is greatly influenced by the contact pressure between adjacent laps, annealing temperature and cooling rate during the cooling period.

The present methods involve utilizing a coil winding tension set at the lowest possible level that can still prevent the coil from telescoping. Coil tensions as low as about 3,000 psi have been tested and proved acceptable. Normal coil winding tensions are typically around 30,000 psi. Particularly good results have been obtained in the batch annealing operation (i.e., minimal sticking) when the reduced operating temperatures are combined with the reduced coil winding tensions.

To assist in the prevention of coil telescoping at such low winding tensions, a modification is preferably made to the mandrel around which the stainless steel is wound. A flat plate is provided at one end of the mandrel so as to be substantially perpendicular to the longitudinal axis of the mandrel. The plate is preferably affixed to the mandrel end, such as by welding. After the coil is wound, the mandrel may be oriented so that the longitudinal axis of the mandrel is substantially vertical with the flat plate below the coil. The weight of the coil resting upon the flat plate prevents the coil from telescoping.

While the low winding tension, that provides low lap-to-lap pressure, is essential for minimizing sticking, another important part of this invention is to control the pressure on the adjacent coil laps in the furnace during the actual batch annealing cycle.

Following the heat treatment at the target temperature, the cooling period commences. In this cooling phase of the process, the outer portion of the coil cools faster and shrinks more than the inner body, thus producing high thermal stresses (pressure) on the lap interfaces within the coil. This occurrence can create conditions where localized welding and sticking may occur.

Through experimentation, it was determined that this unavoidable phenomenon can effectively be minimized by controlling the cooling rate. Cooling rates of about 20° F./hr to 100° F./hr from the target temperatures to about 1300° F. or less was found to be effective for avoiding sticking. Below these temperatures, the cooling can proceed at any rate without an adverse effect on sticking tendency.

In coping with the problem of lap-to-lap sticking, good results were also obtained when the stainless steel strip was coated with a coil lap separating agent, such as corn starch, talc, magnesia, etc., prior to the batch annealing.

Regardless of the austenitic stainless steel alloy selected, the annealing temperature should be chosen so as to be above the dissolution temperature of the carbides and high enough to allow complete recrystallization and an adequate rate of grain growth. The annealing temperature is also necessarily lower than the maximum temperature achievable in a batch annealing furnace, which is currently less than 1700° F. For recrystallization to take place, a minimum temperature of about 1550° F. is required. The holding time at the appropriate annealing temperature should be sufficiently long to allow grain growth for the desired mechanical properties.

To preserve the brightness of the strip surface, it is preferred that the annealing be conducted in a 100% hydrogen atmosphere with the dew point maintained as low as possible. It is also preferred that as much residual rolling oil as possible be removed from the coil laps when the coils are prepared for annealing.

To achieve the low dew point during the annealing cycle, the heating portion of the annealing cycle may incorporate one or more isothermal holding periods of a duration sufficient to permit the evaporation of any residual rolling oil and moisture. During the course of experimentation, two such holding periods were often incorporated. For example, a first isothermal holding period may be implemented in the range of about 700° F. to about 750° F. and a second holding period may be implemented in the range of about 900° F. to about 950° F. The heating rates and any holding periods should be selected so that the dew point is maintained below approximately −85° F.

EXAMPLES

T-201L Stainless Steel

A series of laboratory experiments were conducted with 0.005-inch thick T-201L alloys having 0.023% by weight carbon. Coupons of 8-inch by 10-inch dimensions were enclosed in a carbon steel box, and were subjected to various heating cycles under an atmosphere. The parameters investigated included heating times to the target annealing temperatures ranging from 3.5 to 20 hours, target annealing temperatures ranging from 1500° F. to 1800° F. and annealing periods (i.e., the times at which products are maintained at the target annealing temperatures) ranging from 0 to 8 hours. The cooling rates utilized were all within the realm of the state-of-the-art batch annealing technology, ranging from 20° F. per hour to 100° F. per hour. The cooling rate can be much steeper once the temperature of the steel drops to around 1300° F. or lower. This is because at steel temperatures above around 1300° F., steep cooling rates can induce thermal stresses in the material, which promotes sticking.

The results from the laboratory experiments are summarized in Table 1 for 0.004-inch gauge T-201L stainless steel having 0.023% by weight carbon. Table 1 indicates the minimum conditions required for complete recrystallization, adequate grain growth (an ASTM grain size of about 6 to about 9 for most applications), as well as sufficient carbide dissolution. These minimum conditions include a target temperature lying somewhere between 1600° F. and 1700° F. and a soaking time at the annealing temperature of from about 0 to about 8 hours. Larger coils could require soaking times of about 12 hours or even longer.

When an alloy is resistant to corrosion to an acceptable degree, the alloy is said to have acceptable corrosion resistance properties. Because corrosion is due, to a large extent, to the presence of intergranular carbides, these properties are often referred to in the industry as intergranular corrosion resistance properties. The industry utilizes standard tests called ASTM A262 Practice A and E to evaluate the corrosion resistance properties of alloys and determine whether the corrosion resistance properties are acceptable. ASTM A262 Practice A results in ratings of "step" (little or no carbide precipitation), "dual" (intermediate carbide precipitation) or "ditch" (at least some grains encircled by carbide precipitation). Ratings of "step" or "dual" are considered acceptable while a rating of "ditch" is considered unacceptable. ASTM A262 Practice E results in ratings of either "pass" (acceptable) or "fail" (unacceptable).

In addition to referencing the ASTM A262 Practice A and E tests, a general assessment or rating of the intergranular carbide precipitation is also referenced herein, particularly with reference to Tables 1, 3 and 4. A rating of "Medium" is generally considered an acceptable amount of intergranular carbide precipitation for most applications. General definitions applicable to the various ratings of carbide precipitation are as follows:

"No precipitate": Indicates a step structure as specified by ASTM A262 Practice A. No or occasional carbide precipitation, and no ditching at grain boundaries.

"Trace": Indicates a dual structure as specified by ASTM A262 Practice A. Occasional carbide precipitation in the range of about 10 to 20% at grain boundaries (ditches do not encircle individual grains).

"Light": Indicates a dual structure as specified by ASTM A262 Practice A. Occasional precipitation in the range of about 20 to 40% at grain boundaries (ditches do not encircle individual grains).

"Medium": Indicates a dual structure as specified by ASTM A262 Practice A. Carbide precipitation at the grain boundaries, in which ditches occur at less than about 50% on individual grain boundary lengths (ditches do not encircle individual grains).

"Heavy": Indicates a ditch structure as specified by ASTM A262 Practice A. Carbide precipitation at the grain boundaries, in which ditches encircles some, but not all, of the individual grains.

"Very Heavy": Indicates a ditch structure as specified by ASTM A262 Practice A. Carbide precipitation at the grain boundaries, in which heavy ditches encircle most or all of the grains.

It should also be noted that the presence of globular carbides was also detected in some of the specimens during the experiments. Globular carbides are occasional, undissolved, small remnants from the hot processing. These globular carbides may occur at grain boundaries or as intra-granular carbides. Intra-granular carbides generally did not effect the carbide precipitation ratings in the experiments or the evaluation of whether the carbide precipitation for a particular specimen is sufficient or acceptable.

TABLE 1

| Aim Temp ° F. | Hold Time hr. | ASTM Grain Size | Carbide Precipitation |
|---|---|---|---|
| 1500 | 4 | 10+ | Medium |
| 1500 | 0 | −10 | Light |
| 1650 | 4 | 6.5–7.5 | Trace |
| 1650 | 8 | 7.0–9.0 | Light |
| 1650 | 0 | 10+ | Trace |
| 1650 | 4 | 8.5 | Light |
| 1700 | 8 | 8.5 | Light |
| 1700 | 0 | 8.5–9.0 | Trace |
| 1700 | 4 | 7.5–8.5 | Trace |
| 1700 | 0 | 7.0–8.0 | No Precipitate |
| 1800 | 1 | 6.0–8.5 | No Precipitate |

Mill trials were also conducted with the T-201L alloy. Small, 0.005-inch×11-inch×200 pound, T-201L coils were batch annealed in which the coil winding tension, the dew point of the annealing atmosphere and cooling rate in the annealing cycles varied through a number of annealing runs conducted at 1680° F. with a six-hour annealing time. A typical batch annealing cycle is depicted in FIG. 1. From these trials it was learned that the winding coil tension is very relevant to sticking tendency between the coil laps and that the dew point of the annealing atmosphere did not significantly influence sticking tendency in the ranges investigated. It was further learned that the cooling rate was found to be important, with the slower rate being better in minimizing lap-to-lap sticking. Cooling rates of less than about 100° F. per hour were preferred, with cooling rates of less than about 50° F. per hour being most preferred.

Then, annealing trials were conducted of production-size coils. Three T-201L coils of 0.005-inches×24-inches×up to 10,000 pounds were annealed. A low carbon content was chosen, i.e., between about 0.020 and 0.030 weight percent, and the annealing was conducted at 1680° F. for a six-hour hold period with a cooling rate of ≦50° F. per hour after the annealing. Coil winding tensions used ranged from approximately 3,000 psi to approximately 4,100 psi. As Table 2 shows, the mechanical properties of these coils were comparable to those of conventionally annealed products.

TABLE 2

| Type of Anneal | Batch-1,700 lb Coil | | Batch-6,700 lb Coil | | Batch-10,000 lb Coil | | Line Bright Anneal | |
|---|---|---|---|---|---|---|---|---|
| Gauge | 0.005" | | 0.005" | | 0.005" | | 0.005" | |
| No of Coils | 1 | | 1 | | 1 | | 421 | |
| | Average | Sigma | Average | Sigma | Average | Sigma | Average | Sigma |
| YS, ksi | 53.1 | 1.04 | 57.5 | 0.92 | 55.9 | 1.10 | 53.1 | 2.89 |

TABLE 2-continued

| Type of Anneal | Batch- 1,700 lb Coil | | Batch- 6,700 lb Coil | | Batch- 10,000 lb Coil | | Line Bright Anneal | |
|---|---|---|---|---|---|---|---|---|
| UTS, ksi | 122.1 | 1.48 | 123.7 | 1.84 | 125.3 | 1.68 | 126.0 | 4.36 |
| % Elong | 63.4 | 1.47 | 59.3 | 1.44 | 60.3 | 1.83 | 56.4 | 5.96 |

T-304L Stainless Steel

Similar laboratory experiments were conducted with 0.003-inch gauge T-304L alloy having 0.023% carbon to 0.028% carbon by weight. The heat treatment parameters used were similar to those used for the experiments of the T-201L alloy above. More specifically, the target annealing temperatures were 1680° F. to 1800° F. and the annealing time at the target annealing temperature was either 0, 6, or 12 hours. The results of the laboratory experiments are shown in Table 3. As shown in Table 3, carbide precipitation at the grain boundaries was found in all samples having a heavy amount of intergranular carbides, and these samples failed the corrosion tests (ASTM A262 Practice A and E). This indicated that the carbon level was too high for this material.

TABLE 3

| Aim Temp ° F. | Hold Time hr. | Cooling Rate | ASTM Grain Size | Carbide Precip. | ASTM A262 Practice A | ASTM A262 Practice E |
|---|---|---|---|---|---|---|
| 1680 | 0 | 56 F./hr | 95–10.0 | Heavy | Ditch | Fail |
| 1680 | 6 | 56 F./hr | 8.0 | Heavy | Ditch | Fail |
| 1680 | 6 | 100 F./hr | 8.5 | Heavy | Ditch | Fail |
| 1680 | 12 | 50 F./hr | 7.5 | Heavy | Ditch | Fail |
| 1800 | 6 | 100 F./hr | 7.0–7.5 | Heavy | Ditch | Fail |
| 1800 | 6 | 50 F./hr | 7.0 | Heavy | Ditch | Fail |

Next, a 0.015-inch gauge T-304L alloy having extra low carbon content (i.e., about 0.010% to about 0.015% carbon by weight) was examined in the laboratory. The target annealing temperature varied from 1550° F. to 1800° F. The annealing time at the target annealing temperature ranged from 0 to 12 hours. The cooling rate was 56° F. per hour. As shown in Table 4, these samples passed ASTM A262 Practices A and E corrosion resistance tests, even after a sensitization treatment at 1250° F. for one hour.

TABLE 4

| Aim Temp ° F. | Hold Time hr. | Cooling Rate | ASTM Grain Size | Carbide Precip. | ASTM A262 Prac A | ASTM A262 Prac E | Mechanical Properties YS, ksi | UTS ksi | % Elong |
|---|---|---|---|---|---|---|---|---|---|
| 1680 | 6 | 56 F./hr | 5.0–8.0 | No Precip. | Step | Pass | 34.3 | 86.6 | 63.3 |
| 1800 | 6 | 56 F./hr | 4.5–6.0 | No Precip. | Step | Pass | 31.8 | 85.4 | 65.0 |
| 1550 | 6 | 56 F./hr | 9 | Medium | Dual | Pass | 41.1 | 96.0 | 50.3 |
| 1600 | 6 | 56 F./hr | 8.5 | No Precip. | Step | Pass | 39.1 | 92.3 | 52.8 |
| 1600 | 0 | 56 F./hr | 9.5 | Medium | Dual | Pass | 42.6 | 97.1 | 48.3 |
| 1650 | 0 | 56 F./hr | 9 | Trace | Dual | Pass | 39.5 | 93.8 | 49.8 |
| 1550 | 12 | 56 F./hr | 8.5–9.0 | Medium | Dual | Pass | 40.1 | 95.6 | 48.5 |
| 1600 | 12 | 56 F./hr | 8.5–9.0 | No Precip. | Step | Pass | 38.0 | 92.2 | 49.8 |

Mill trials were also conducted with a T-304L coil having a carbon content of about 0.010% to about 0.015% by weight carbon, and dimensions of 0.004-inches×24-inches by 4000 pounds. The coil was annealed at 1560° F. for a 6-hour annealing period and a cooling rate of ≦50° F. per hour. The maximum coil winding tension used was 3,700 psi. Table 5 shows the mechanical properties of this coil which were comparable to those of conventionally produced products.

TABLE 5

| Type of Anneal | Batch- 4,000 lb. Coil | | Line Anneal | | Line Anneal | |
|---|---|---|---|---|---|---|
| Gauge | 0.004" | | 0.004" | | 0.015" | |
| No of Coils | 1 | | 2 | | 150 | |
| | Average | Sigma | Average | Sigma | Average | Sigma |
| YS, ksi | 35.0 | 1.0 | 38.0 | 1.41 | 36.3 | 2.70 |
| UTS, ksi | 89.0 | 1.0 | 92.0 | 1.41 | 90.6 | 2.76 |
| % Elong | 48.7 | 2.5 | 57.0 | 1.41 | 58.4 | 2.82 |

For recrystallization and adequate grain growth, required for the desired mechanical properties, the cold-rolled material must be heated above the carbide dissolution temperature of the alloy and held at temperature for a time sufficient to allow the carbides to dissolve. Carbide dissolution is necessary for "unpinning" the newly-recrystallized grains, thus allowing them to grow at a reasonable rate to the desired size.

The lower carbon level in the austenitic stainless steel alloys allows recrystallization and grain growth at a lower temperature. Also, the lower carbon level allows less carbides to form during heating, and therefore provides a shorter time to dissolve afterward. Lower carbon levels are essential in preventing carbide precipitation at grain boundaries during the slow cooling period inherent in the batch annealing process.

Based on the experiments, it was found that when carbon levels are sufficiently low in a particular alloy, existing batch annealing technology can be adapted for commercial production. With the use of an appropriate annealing cycle and other parameters, microstructures can be developed with no intergranular carbides, and thus no intergranular corrosion susceptibility and with acceptable mechanical properties.

For the particular alloys tested, it was found that the minimum requirement for annealing T-201L alloy having about 0.02% to about 0.03% by weight carbon is to hold the alloy at the annealing temperature of 1650° F. for 0 hour (i.e., when the temperature of the cold spot reaches the target annealing temperature, the temperature is immediately dropped to the cooling cycle). For the T-304L alloy, carbon contents of about 0.01% to about 0.015% by weight allow the minimum requirement of a temperature of about 1550° F. for approximately 6 hours. Thus, for T-201L alloys, the carbon content should be less than about 0.03% by weight, while for T-304L alloys, the carbon content should be less than about 0.015% by weight.

Although the invention has been described with respect to certain preferred embodiments, it is distinctly understood that the invention is not limited to those embodiments. For example, examples have been provided for T-201L and T-304L alloys, but other alloys may be annealed according to the present invention. In fact, the process of the present invention may be applied to any austenitic grade stainless steel in which the chemistry is selected such that recrystallization and grain growth will be adequate at the maximum temperature limit of a batch annealing furnace. As discussed herein, the annealing parameters must be such so that carbide precipitation does not occur during cooling to a degree which would render the corrosion and/or mechanical properties of the alloy unacceptable.

While certain present preferred embodiments have been shown and described, it is distinctly understood that the invention is not limited thereto, but may be otherwise embodied within the scope of the following claims.

We claim:

1. A method for annealing austenitic stainless steel comprising the steps of:

heating said austenitic stainless steel in a batch annealing furnace at an annealing temperature for an annealing time period;

wherein said austenitic stainless steel has a sufficiently low weight percentage of carbon so that annealing occurs with an intergranular carbide precipitation rating of medium or less.

2. The method of claim 1 wherein said annealing temperature is less than about 1700° F.

3. The method of claim 1 wherein said austenitic stainless steel is T-201L stainless steel.

4. The method of claim 3 wherein said weight percentage of carbon is less than about 0.030 weight percent.

5. The method of claim 4 wherein said annealing temperature is within a range of about 1600° F. to about 1700° F.

6. The method of claim 5 wherein said austenitic stainless steel is annealed for a time period of less than about 12 hours.

7. The method of claim 5 further comprising the step of cooling said austenitic stainless steel at a cooling rate of less than about 100° F. per hour after said austenitic stainless is heated at said annealing temperature.

8. The method of claim 3 further comprising the step of coiling said austenitic stainless steel and applying a winding tension of less than about 30,000 psi to said coiled stainless steel prior to said batch annealing step.

9. The method of claim 8 wherein said winding tension is within the range of about 3,000 psi to about 15,000 psi.

10. The method of claim 4 wherein said austenitic stainless steel has a gauge of less than about 20 mils.

11. The method of claim 1 further comprising the step of coiling said austenitic stainless steel and applying a winding tension of less than about 30,000 psi to said coiled stainless steel prior to said batch annealing step.

12. The method of claim 11 wherein said winding tension is within the range of about 3,000 psi to about 15,000 psi.

13. The method of claim 1 wherein said austenitic stainless steel is T-304L stainless steel.

14. The method of claim 13 wherein said weight percentage of carbon is less than about 0.023 weight percent.

15. The method of claim 14 wherein said weight percentage of carbon is less than about 0.015 weight percent.

16. The method of claim 14 wherein said austenitic stainless steel has a gauge of less than about 20 mils.

17. The method of claim 14 wherein said annealing temperature is within a range of about 1550° F. to about 1700° F.

18. The method of claim 17 wherein said austenitic stainless steel is annealed for a time period of less than about 12 hours.

19. The method of claim 17 further comprising the step of cooling said austenitic stainless steel at a cooling rate of less than about 100° F. per hour after said austenitic stainless steel is heated at said annealing temperature.

20. The method of claim 13 further comprising the step of coiling said austenitic stainless steel and applying a winding tension of less than about 30,000 psi to said coiled stainless steel prior to said batch annealing step.

21. The method of claim 20 wherein said winding tension is within the range of about 3,000 psi to about 15,000 psi.

* * * * *